US011834236B2

(12) United States Patent
Livingston

(10) Patent No.: US 11,834,236 B2
(45) Date of Patent: Dec. 5, 2023

(54) CONTAINER CONTENT ALIGNMENT APPARATUS AND SYSTEM

(71) Applicant: Iconex LLC, Duluth, GA (US)

(72) Inventor: Timothy Darren Livingston, Corryton, TN (US)

(73) Assignee: Iconex LLC, Duluth, GA (US)

( * ) Notice: Subject to any disclaimer, the term of this patent is extended or adjusted under 35 U.S.C. 154(b) by 0 days.

(21) Appl. No.: 17/589,362

(22) Filed: Jan. 31, 2022

(65) Prior Publication Data

US 2023/0242302 A1 Aug. 3, 2023

(51) Int. Cl.

| | |
|---|---|
| ***B65D 5/56*** | (2006.01) |
| ***B65D 5/32*** | (2006.01) |
| ***B65D 5/42*** | (2006.01) |
| ***B65D 5/468*** | (2006.01) |
| ***B65D 5/46*** | (2006.01) |

(52) U.S. Cl.

CPC ..... *B65D 5/566* (2013.01); *B65D 5/327* (2013.01); *B65D 5/4266* (2013.01); *B65D 5/4608* (2013.01); *B65D 5/46128* (2013.01); *B65D 5/563* (2013.01); *B65D 2525/283* (2013.01)

(58) Field of Classification Search

CPC ..... B65D 5/566; B65D 5/327; B65D 5/4266; B65D 5/4608; B65D 5/46128; B65D 5/563; B65D 2525/283; B65D 5/0254; B65D 25/10; B65D 83/0805; G09F 2003/0201; B41J 11/58

USPC ..... 229/122.32, 120.33, 122, 942; 400/613.2; 221/287, 303; 206/215; 220/23.89; 493/912, 90

See application file for complete search history.

(56) References Cited

U.S. PATENT DOCUMENTS

| | | | | |
|---|---|---|---|---|
| 4,369,914 A | | 1/1983 | Langston, Jr. et al. | |
| 5,000,431 A | | 3/1991 | Mckay | |
| 5,080,236 A | * | 1/1992 | Conner | B41J 11/58 211/151 |
| 5,630,511 A | * | 5/1997 | Bose | B65D 83/0805 206/215 |
| 6,547,126 B2 | * | 4/2003 | Freiborg | B65D 5/4804 206/323 |
| 7,222,817 B2 | * | 5/2007 | Stringer | B65D 85/672 242/588.3 |
| 8,196,806 B2 | | 6/2012 | Tao | |

(Continued)

FOREIGN PATENT DOCUMENTS

| | | | | |
|---|---|---|---|---|
| JP | 2007238212 A | * | 9/2007 | |
| WO | WO-0044631 A1 | * | 8/2000 | B65D 5/5038 |
| WO | WO-2015168277 A1 | * | 11/2015 | B32B 27/08 |

*Primary Examiner* — Christopher R Demeree

(74) *Attorney, Agent, or Firm* — Schwegman Lundberg & Woessner, P.A.

(57) ABSTRACT

A container content apparatus comprises two inserts. Each insert comprises a top portion, a bottom portion, and two side flaps. Each top portion comprises a die cut handle. The apparatus is adapted to be inserted into an inside of a container adjacent to interior walls of the container. An area defined by the inserts is adapted to receive a stack of media. When the inserts are removed via the handles, a gap or space exists between the outer edges of the stack and the interior walls of the container providing automatic alignment of the stack centered on the inside of the container and providing proper alignment to feed the stack directly from the container to an infeed of a printer.

20 Claims, 8 Drawing Sheets

(56) References Cited

U.S. PATENT DOCUMENTS

| | | | | |
|---|---|---|---|---|
| 8,424,681 | B1 * | 4/2013 | Schonhardt | B65D 5/5035 229/117.14 |
| 10,543,954 | B2 | 1/2020 | Couture | |
| 2012/0080512 | A1 | 4/2012 | Gray et al. | |

* cited by examiner

CONTAINER CONTENT ALIGNMENT APPARATUS AND SYSTEM

BACKGROUND

Many businesses still require print media for a variety of situations. For example, pharmacies must print custom labels for each customer that identifies the customer, the medicine, the warnings for the medicine, the interactions between the medicine and other medicines, etc. A product manufacturer or shipper requires labels that identify the delivery address, identifies the contents of what is being shipped, and provides a return address to businesses and customers that are receiving shipped products, A fast-food restaurant prints labels with a specific order of each customer on it so that staff preparing the order can verify a fulfilled order correctly.

For industries that require large label applications, such as pharmacies and manufacturers/shippers, labels are purchased in large printer stacks or webs. The stack of labels are situated under a printer on the floor and fed through a media infeed of the printer. These stacks can be large weighing as much as 40 to 50 pounds, Unfortunately, the labels cannot be fed to the in feed directly from the carton that the labels were shipped in because the labels rub against the sides of the box causing resistance, which causes the printer to be unable to feed the stack through the printer or causes misalignment and media jams within the printer.

Thus, businesses have a specific process that is required before a stack of labels are fed to the printer. First, the carton is opened, and the flaps are folded flat, the carton is then flipped over (no easy task when the label stacks typically weigh over 40 pounds), the carton is removed from the stack, any liner bag associated with the labels is separated from the label stack, the stack is moved and positioned under the printer on the floor in alignment with the label infeed mechanism, and the labels are feed through the printer infeed mechanism. Often when moving the stack to the floor in front of the printer or when flipping the carton upside down to separate the box and the stack, the stack gets broken or out of alignment, which will cause printer misalignments and printer jams during printing of the labels. Unfortunately, there is no present technique by which the labels can remain in the original shipping container and fed through the printer infeed for application by the business.

SUMMARY

In various embodiments, an apparatus, a system, and a method for container content alignment are provided.

Specifically, and in an embodiment, a container content alignment apparatus is provided. The apparatus comprises two container inserts. Each insert comprises a top portion, a bottom portion and two side flaps. The two container inserts are adapted to fit inside a container adjacent to an inside surface of the container defined by front, back, and side walls. An area between the two container inserts is adapted to receive a stack of labels. When the two inserts are removed from the container, a gap or space exists between outer edges of the stack of labels and the inside surface defined by the front, the back, and the side walls ensuring that the stack of labels is centered within the container for directly feeding the stack of labels to an infeed of a printer from the container.

DETAILED DESCRIPTION

Figure 1:
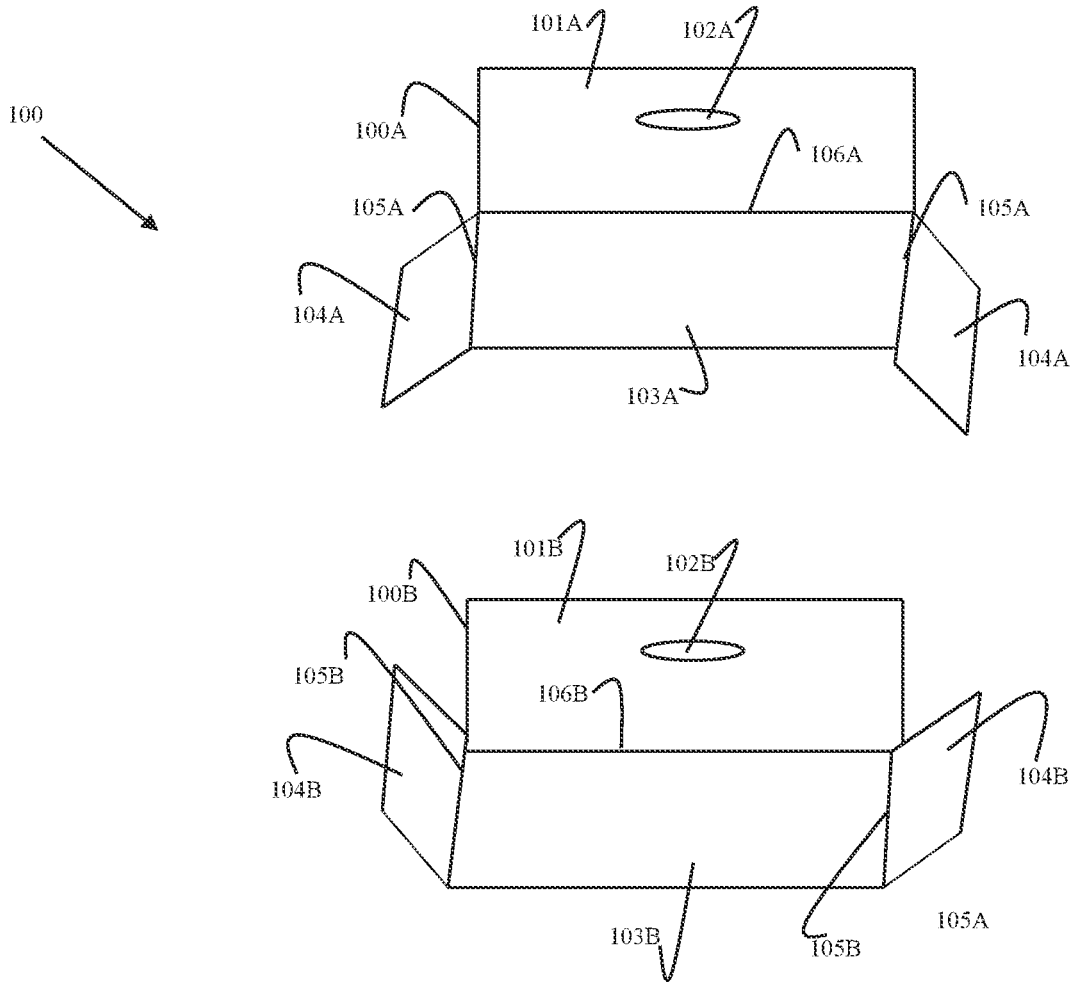
FIG. 1 is a diagram of a container content alignment apparatus, according to an example embodiment.

FIG. 1 is a diagram of a container content alignment apparatus 100, according to an example embodiment.

As used herein the terms "media, "content," "label stack," may be used synonymously and interchangeably along with the phrase "print media." Print media comprises a substrate for which at least one side includes a deposited print coating or image coating (thermal coating). The substrate of the media may comprise a paper-based material and/or a synthetic-based material. The print/image coating enables dot matrix, laser-based, or thermal-based printing of custom indicia. For example, a thermal sensitive (image) coating enables thermal imaging either through direct thermal heat or through terminal transfer heat selectively applied on the surface of the media having the image coating by thermal print heads of a thermal printer. The media also may include preprinted branding or designs that is Ultra-Violet (UV) flexo printed during the manufacturing process. The print media or label stack comprises a plurality of fanfold label sheets with liner.

The print media/content is a stack or web of unimaged labels or partially unimaged labels. The labels comprise a liner a liner substrate. The labels are precoated with image coatings, adhesive coatings, and/or release coatings for application by a business through custom printing/imaging of indicia on the labels and/or liners. The labels are stacked in a container/carton and shipped to the business for application (via custom printing/imaging of indicia).

The conventional manner in which the labels are stacked in the carton and the conventional manner by which the labels are fed to a printer are changed herein by the container content alignment apparatus, system, and method discussed herein and below.

Conventionally, fanfold labels are packaged in a container/box and wrapped in a plastic bag, this is necessary to prevent moisture from seeping into the box and damaging the labels. The plastic bag is removed from the packing process of the fanfold labels for purposes of the embodiments presented herein and below. The inside surfaces of the container along with the inside surfaces of the container alignment apparatus are coated with moisture resistant coating that shields the fanfold label stack from retaining moisture while in transit to a destination.

Referring now to the container content alignment apparatus 100 ("combination 100") of FIG. 1. Apparatus 100 comprises two container inserts 100A and 100B. Each container insert (100A and 100B) comprises a top portion 101A and 101B, a die cut aperture handle 102A and 102B, a bottom portion 103A and 103B, two side flaps 104A and 104B, two side creases 105A and 105E that allow the correspond side flaps 104A and 104B to fold relative to the corresponding bottom portion 103A and 103B, and a top crease 106A and 106B that allow the corresponding top portion 101A and 101B to told relative to the corresponding bottom portion 103A and 103B.

Container inserts 100A and 100B may be manufactured of a same material and the container/carton in which the labels (content) are shipped in. Moreover, the thickness of the material for inserts 100A and 100B may correspond to the thickness of the container.

In an embodiment inserts 100A and 100B are manufactured or a different material from that which is associated with the carton.

In an embodiment, the thickness of the material for the inserts 100A and 100B is different from the thickness of the material used with the container (inserts 100A and 100B can have a greater thickness than the container thickness or less thickness than the container thickness).

Figure 5:
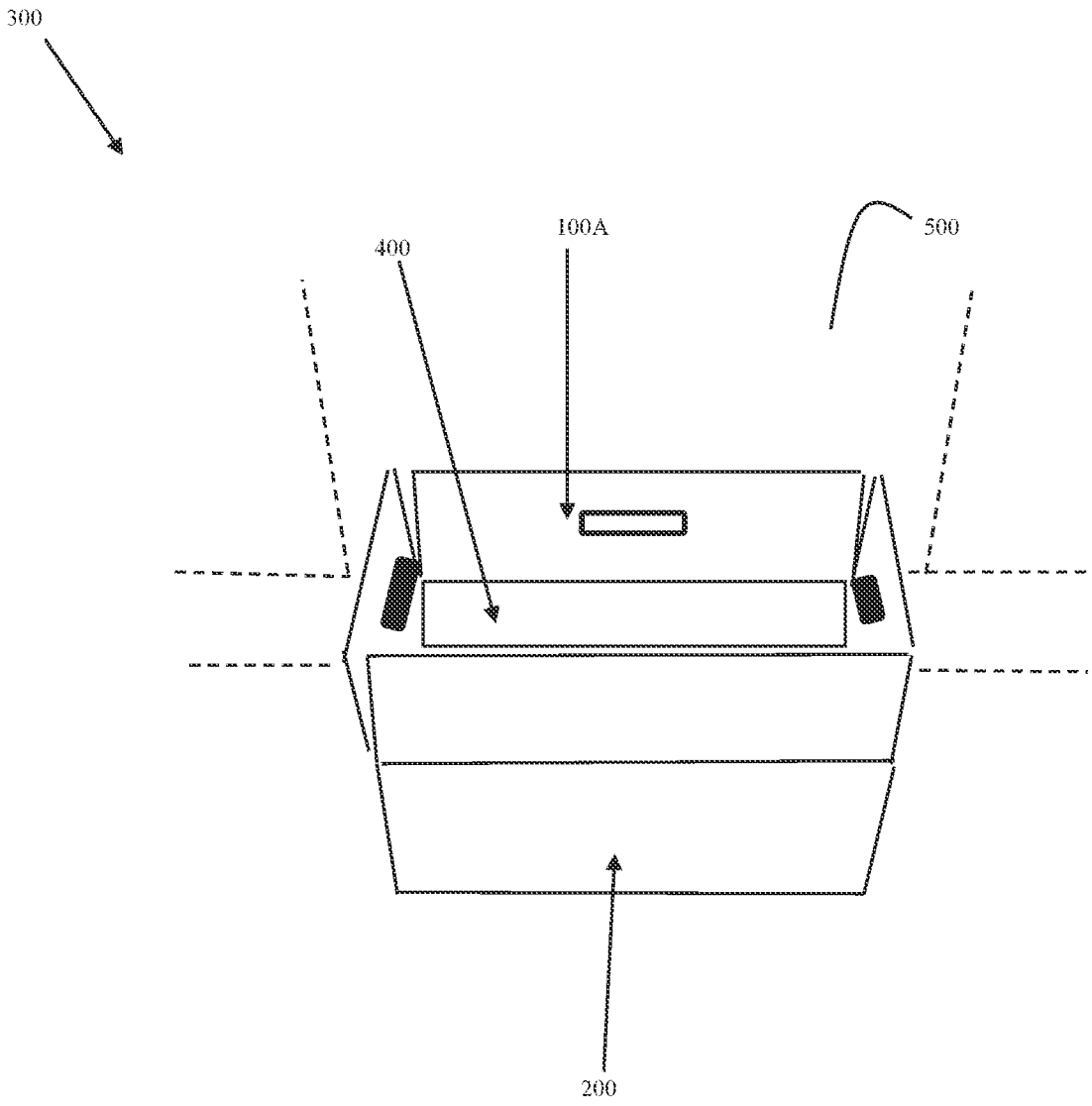
FIG. 5 is a diagram of the system with the apparatus and content placed in front of a printer prior to removing the apparatus, according to an example embodiment.

A height of the combined top portion 101A/101B and bottom portion 103A/103B is substantially equal to a height of the container from its bottom to its top portion when opened (see FIG. 5). A height of the bottom portion 103A/103B is substantially equal to the height of the container's bottom, such that crease 106A substantially aligns with the corresponding crease in the container's top flap. The height of the side flaps 104A/104B are equal to the height of bottom portion 103A/103B. Each side flap 104A folds at least 90 degrees inward from bottom portion 103A/103B along crease 105A/105B and extends at least half the distance of a width of the container, such that when both inserts 100A and 100B are inserted inside the container along the inner container perimeter, a pair of flaps 104A/104B extend inside for a full width of the container.

Figure 4:
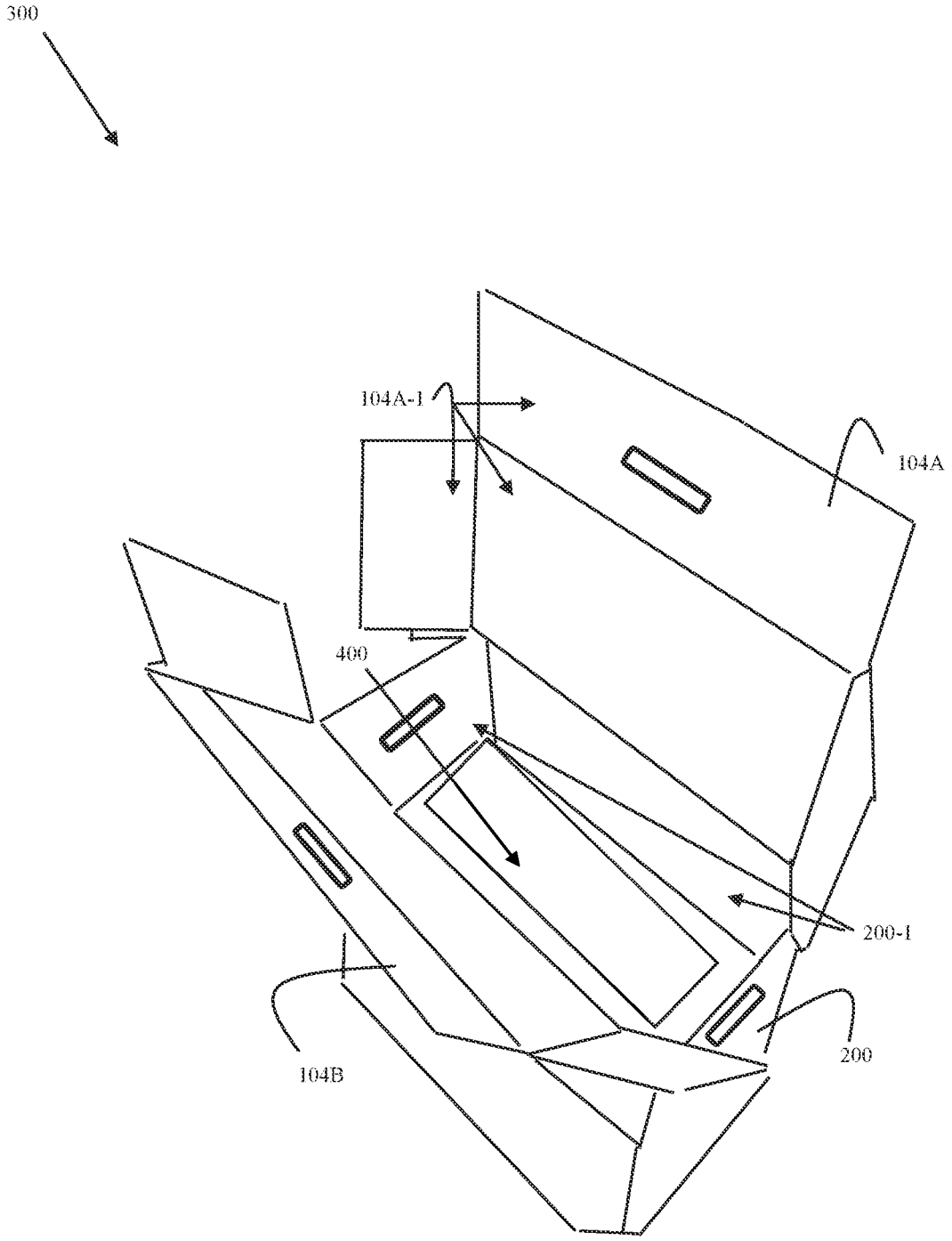
FIG. 4 is a diagram of illustrating removal of the apparatus from the system with the content aligned in the container after removal, according to an example embodiment.

Inside surfaces of portions 101A and 101B are coated with a moisture resistant 104A-1 coating and inside surfaces of container 200 are also coated with a moisture resistant coating 200-1 (as illustrated in FIG. 4). This permits the label stack 400 from needing to have a plastic bag wrapped around the label stack 400 before the label stack 400 is inserted into the container 200 and sealed for transport to a destination. Conventionally, the liner bag or plastic bag was necessary and had to be physically removed before the label stack was placed in front of a printer for printer imaging because if the bag remained around the label stack resistance from the bag would create enough drag on the label stack to disrupt proper feeding and alignment to the printer. This plastic or liner bag is no longer necessary and because the inside surfaces of the container 200 and the portions 101A and 101B are precoated with a moisture resistant coating (104A-1 and 200-1) such that no moisture seeps into the label stack 400 during transport and the labels stack 400 can remain in the container 200 during printing and are fed directly from the container 200 to the infeed of the printer.

Figure 2:
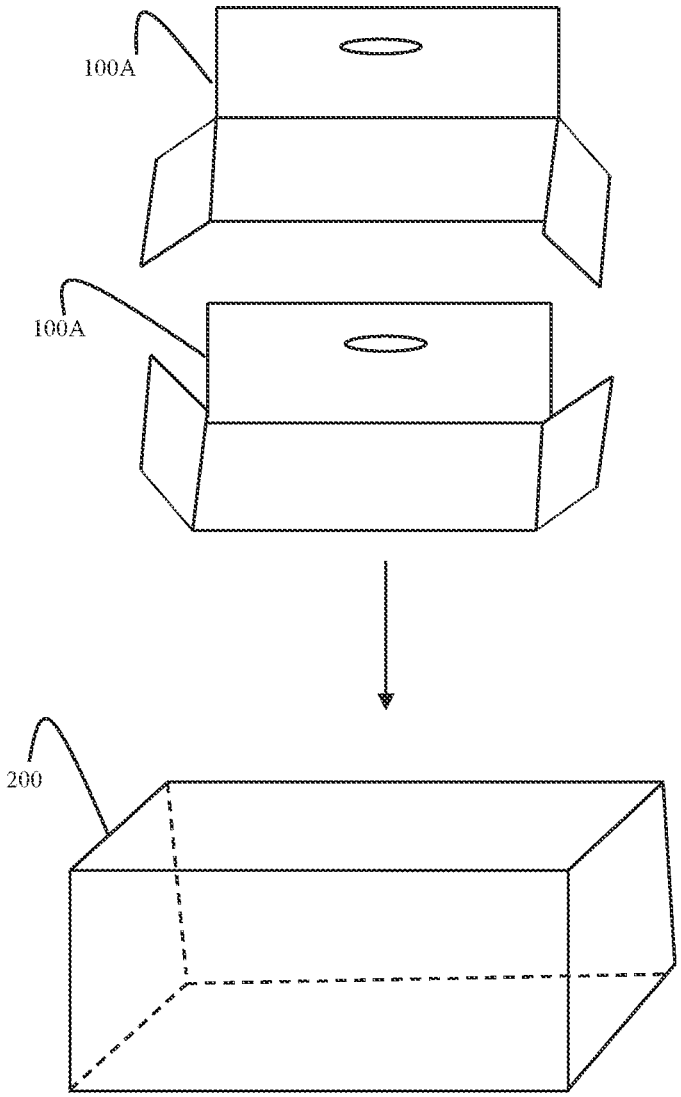
FIG. 2 is a diagram illustrating alignment and orientation of before placing the apparatus in a container for content alignment, according to an example embodiment.

FIG. 2 is a diagram illustrating alignment and orientation of before placing the apparatus 100 in a container 200 for content/label stack 400 (see FIG. 4 below) alignment, according to an example embodiment.

Each insert 100A and 100B are oriented to oppose one another, such that 100A is inserted into container 200 along the back or rear side of the container 200 and 100B is inserted into container 200 along a front side of the container 200. Flaps 104A/104B are folded along creases 105A/105B and tucked into container 200 along the side walls of the container 200 such that an end of 104A touches or aligns with a corresponding end of 104B.

Figure 3:
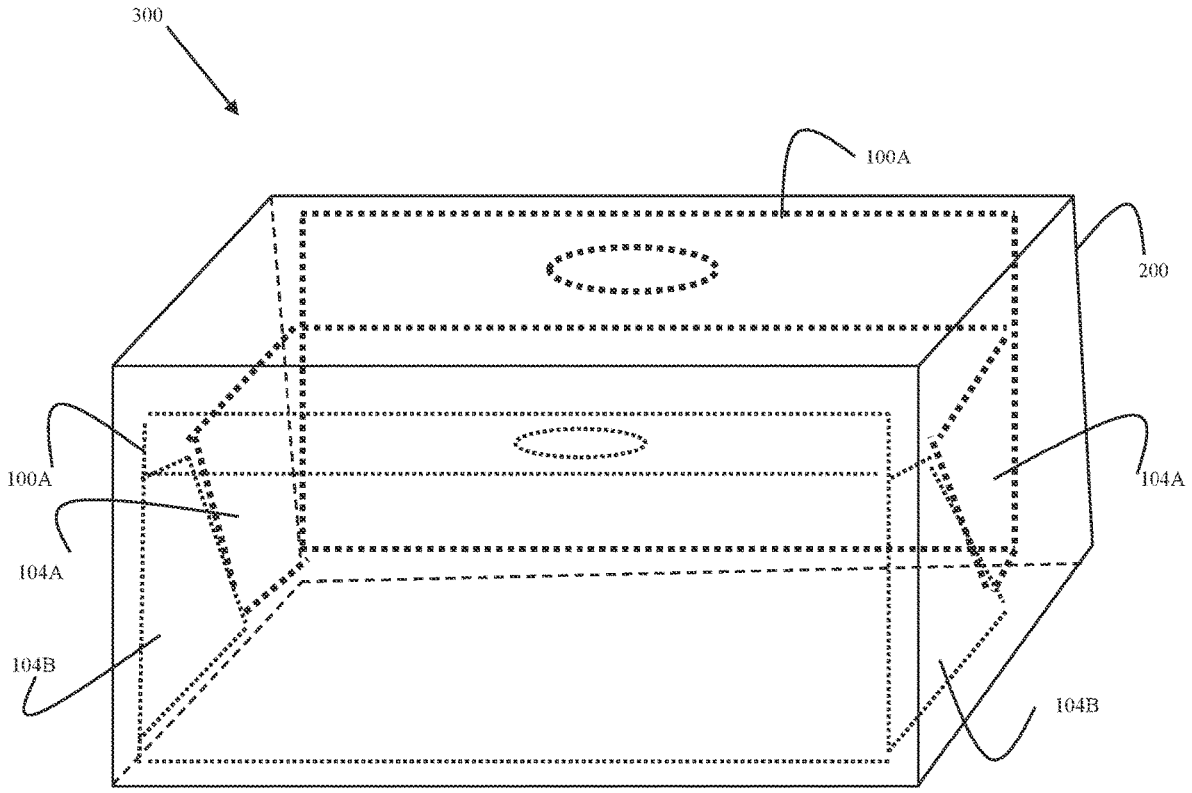
FIG. 3 is a diagram of a system with the apparatus inserted into a container for content alignment, according to an example embodiment.

FIG. 3 is a diagram of a system 300 with the apparatus 100 inserted into a container 200 for content (label stack 400) alignment, according to an example embodiment.

System 300 comprises a container 200 and apparatus 100. The inserts 100A and 100B are inserted along and inside surface perimeter of container 200 such that flaps 104A meet flaps 104B on the inside of side walls of container 200. The front and rear walls of container 200 are covered by first portions 101A/101B and bottom portions 103A/103B. This alignment creates a perimeter around the inside of container 200 having a width that corresponds to a width of the material used for inserts 100A and 100B.

Inserts 100A and 100B create a barrier between the side, front, and rear walls of container 200, such that when a label stack 400 is inserted into the container 200, the stack is automatically aligned and centered within the container 200.

FIG. 4 is a diagram of illustrating removal of the apparatus 100 from the system 300 with the content (label stack 400) aligned in the container 200 after removal, according to an example embodiment.

The label stack/content is loaded into container 200 once inserts 100A and 100B are inserted into the container 200 in the manner discussed above with FIG. 3. Once the container 200 is received by the business, the carton 200 is carried to the floor beneath the printer infeed of the printer, the carton 200 is opened, and each insert 100A and 100B is removed by grabbing handles 102A and 102B and lifting the inserts 100A and 100B out of the container 200.

FIG. 5 is a diagram of the system 300 with the apparatus 100 and content 400 placed in front of a printer 500 prior to removing the apparatus 100, according to an example embodiment.

Once the container 200 with the label stack 400 is loaded inside the inside perimeter of the inserts 100A and 100B, the container 200 can be placed directly under the media infeed of printer 500 on the floor and inserts 100A and 100B are removed by pulling up on handles 102A and 102B.

Figure 6:
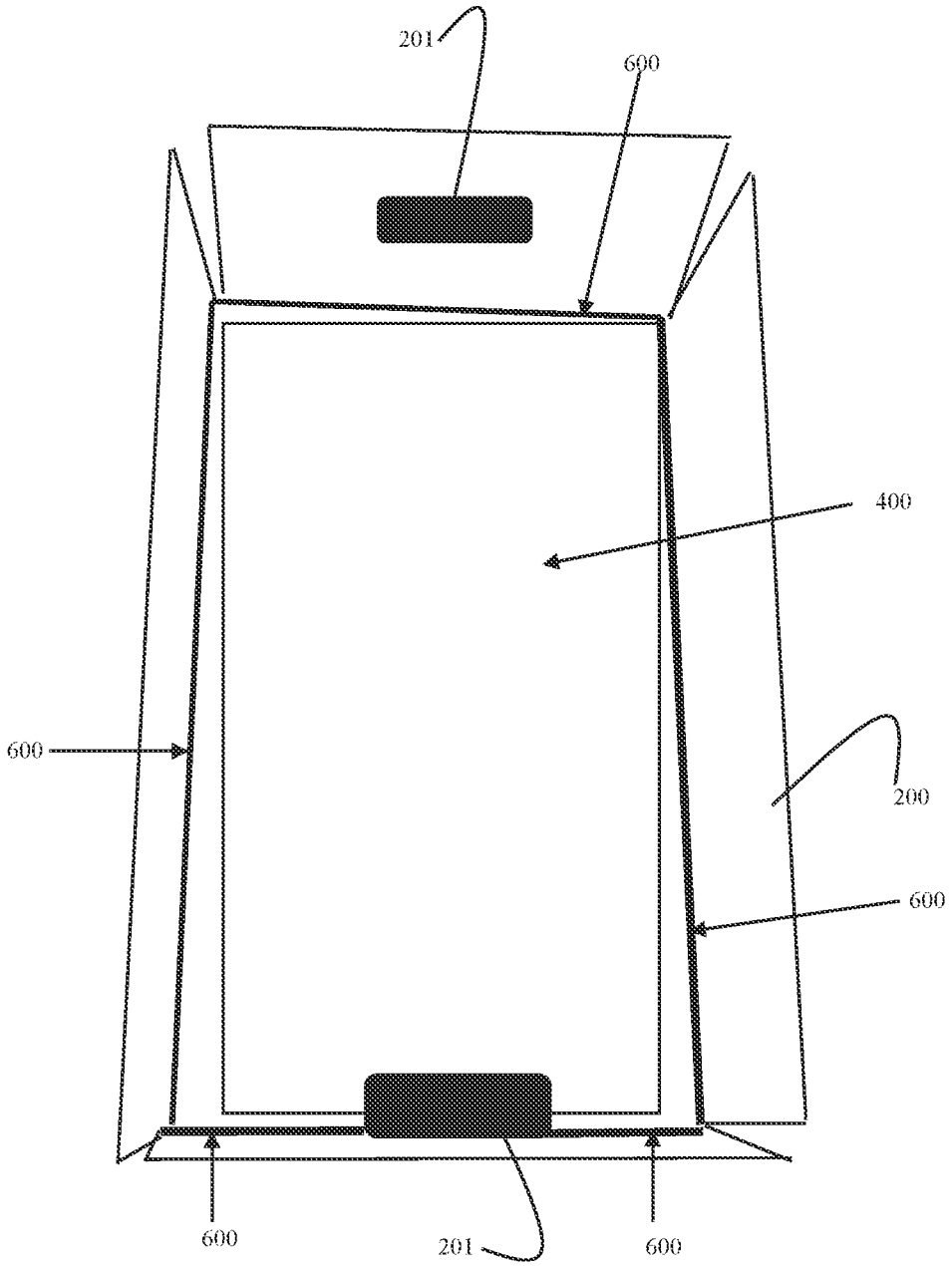
FIG. 6 is a diagram of content aligned in the container after removal of the apparatus with the container situated underneath and infeed to a printer, according to an example embodiment.

FIG. 6 is a diagram of content 400 aligned in the container 200 after removal of the apparatus 100 with the container 200 situated underneath and infeed to a printer 500, according to an example embodiment.

FIG. 6 illustrates a gap 600 (shown via the white outline of a label stack 400 with the dark black space between the stack 400 in FIG. 6). Essentially, stack 400 is not touching the inside of container 200 and a uniform gap 600 exits around the outer perimeter of stack 400 and an inside surface of container 200. This ensures that when a starting label sheet is fed into the infeed of printer 500 and the printer 500 begins pulling the stack 400 through the printer 500 for customer printing or imaging of indicia on the labels that the stack 400 does not touch or engage the four sides of container 200.

FIG. 6 also illustrates handles 201 in the container 200 used for lifting and carrying the container 200. The die cut flaps 201 are folded in towards stack 400 and should be pushed out to face away from stack 400 prior to feeding the stack 400 to the printer 500.

Figure 7:
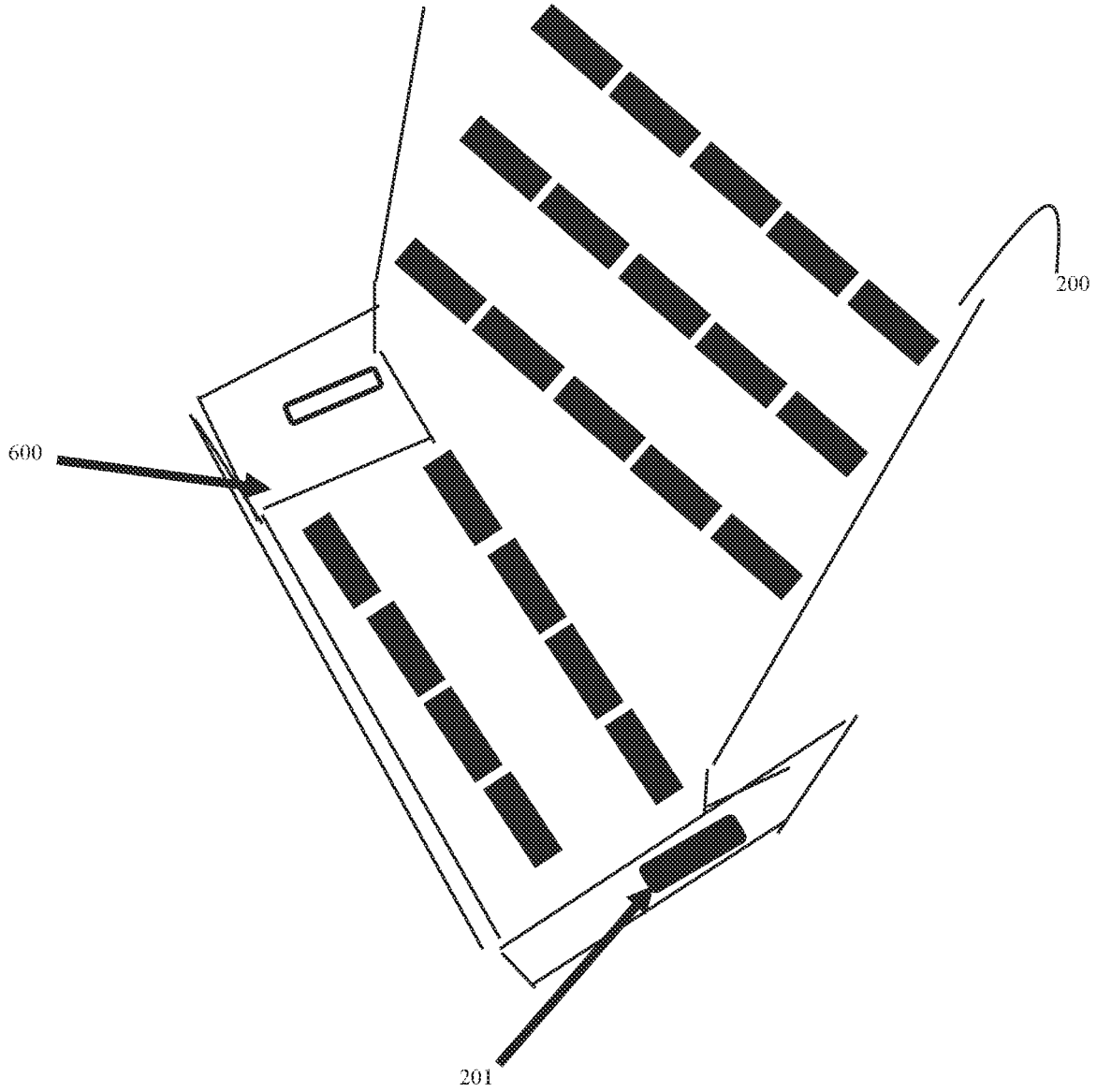
FIG. 7 is a diagram with the content aligned and fed into the infeed of the printer from the container, according to an example embodiment.

FIG. 7 is a diagram with the content 400 aligned and fed into the infeed of the printer 500 from the container 200, according to an example embodiment.

FIG. 7 shows handle flaps 201 of the container pushed out in a direction away from the stack 400 and illustrates the proper position of handle flaps 201. This ensures that no part of the container 200 touches or puts resistance on the label stack 400 as the infeed of printer 500 pulls the labels from the stack 400.

Inserts 100A and 104E can be customized for the size and dimensions of the container 200, such that many different sizes of label stacks 400 can be used with apparatus 100 for automatic alignment of the labels/content within the container 200.

Figure 8:
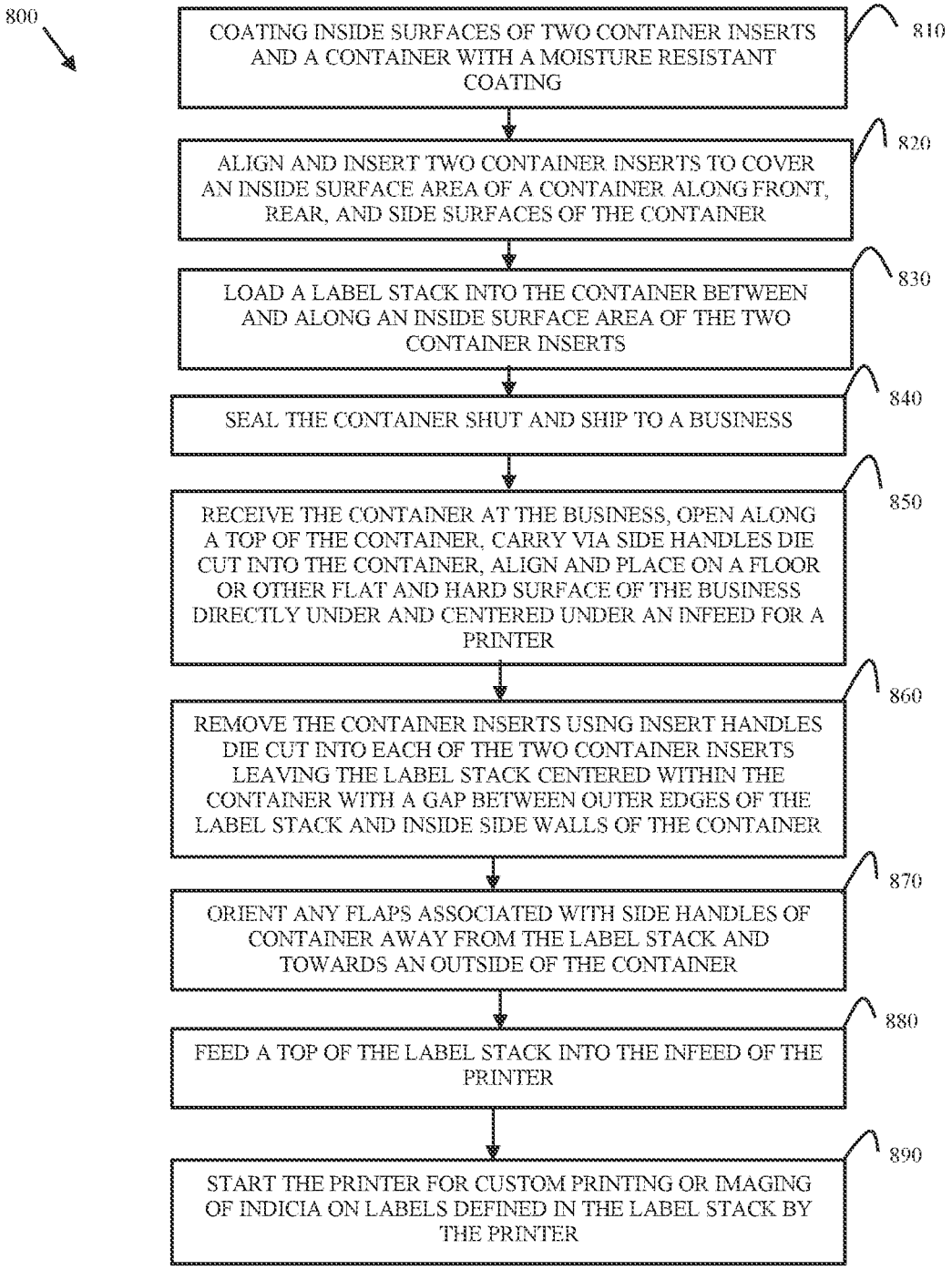
FIG. 8 is a diagram of a method for aligning content within a container, according to an example embodiment.

FIG. 8 is a diagram of a method 800 for aligning content within a container, according to an example embodiment.

At 810, inside surfaces of two container inserts and a container are coated with a moisture resistant coating.

At 820, the two container inserts are aligned and inserted into the container for covering an inside surface area of the container along the front, rear, and side surfaces of the container.

At 830, a label stack is loaded into the container between and along an inside surface area of the two container inserts.

At 840, the container is sealed shut and shipped to a business.

At 850, the container is received at the business, opened along a top of the container, carried via side handles die cut into the container, and the container is aligned on a floor or other flat and hard surface of the business directly under and centered under an infeed for a printer.

At 860, the two container inserts are removed using insert handles die cut into each of the two container inserts leaving the label stack centered within the container with a gap between outer edges of label stack and inside side walls of the container.

At 870, any flaps associated with the side handles are oriented away from the label stack towards an outside of the container.

At 880, a top of the label stack is fed into the printer infeed.

At 890, the printer is started for custom printing or imaging of indicia on labels defined in the stack by the printer.

Although the present invention has been described with particular reference to certain preferred embodiments thereof, variations and modifications of the present invention can be affected within the spirit and scope of the following claims,

The invention claimed is:

1. An apparatus, comprising:
two container inserts;
each container insert comprises:
a top portion;
a bottom portion; and
two side flaps;
wherein the two container inserts adapted to fit inside a container adjacent to an inside surface of the container defined by front, back, and side walls;
wherein an area between the two container inserts adapted to receive a stack of labels;
wherein when the two inserts are removed from the container a gap or space exists between outer edges of the stack of labels and the inside surface defined by the front, the back, and the side walls ensuring that the stack of labels is centered within the container for directly feeding the stack of labels to an infeed of a printer from the container.

2. The apparatus of claim 1, wherein each top portion comprises a die cut handle adapted to lift the corresponding container insert out of the container when the container is loaded with the stack of labels.

3. The apparatus of claim 1, wherein each bottom portion comprises the two side flaps as appendages along sides of the corresponding bottom portion.

4. The apparatus of claim 1, wherein each side flap comprises a crease or a fold adapted to bend the corresponding side flap to fit against a corresponding side wall of the container while the corresponding bottom portion fits against the corresponding front wall or the corresponding back wall of container.

5. The apparatus of claim 1, wherein a height and a length of each top portion is substantially equal to a corresponding height and corresponding length of a container top portion for the container.

6. The apparatus of claim 5, wherein a height and a length of each bottom portion is substantially equal to a corresponding height and a corresponding length of the front wall of the container or the back wall of the container.

7. The apparatus of claim 6, wherein each side flap has one half the length of one of the side walls for the container.

8. The apparatus of claim 7, wherein a height of each side flap is substantially equal to a corresponding height of one of the side walls.

9. The apparatus of claim 1, wherein a thickness of the two container inserts is equal to a corresponding thickness associated with a material used to manufacturer the container.

10. The apparatus of claim 1, a thickness of the two container inserts is less than or greater than a corresponding thickness associated with a material used to manufacturer the container.

11. The apparatus of claim 1, wherein the two container inserts are manufactured of a same material that is used to manufacture the container or the two container inserts are manufactured of a first material that is different from a second material used to manufacture the container.

12. The apparatus of claim 1, wherein inside surfaces of the container and the two container inserts comprise a moisture resistant coating.

13. A system, comprising:
a container;
an apparatus comprise two container inserts;
each container insert comprises:
a top portion comprising a die cut handle; and
a bottom portion comprising two side flaps;
wherein the two container inserts adapted to be inserted into the container and cover inside walls of the container by a thickness of a material used to manufacture the two container inserts;
wherein an area defined on an inside of two container inserts is adapted to receive a stack of labels;
wherein when the die cut handles are pulled up on and removed from the container, a gap of the thickness remains between outer edges of the stack of labels and the inside walls of the container ensuring the stack of labels is centered within the container and only contacts the container on a bottom of the container but does not contact or touch the container along the inside walls;
wherein inside surfaces of the two container inserts and the container comprise a moisture resistant coating.

14. The system of claim 13, wherein the top portion of each container insert is separated by a fold or a crease from the corresponding bottom portion allowing the corresponding top portion to be folded over onto the stack when a container top is sealed shut.

15. The system of claim 13, wherein the bottom portion of each container insert comprises two folds or creases, each fold or crease corresponding to one of the two side flaps permitting each side flap to be folded against a side wall of the container while the corresponding bottom portion remains against a front wall or a back wall of the container.

16. The system of claim 13, wherein a height of each of the bottom portions and each of the corresponding two side flaps is equal to a height of the container when the container is sealed shut for transport.

17. The system of claim 16, wherein a combined length of a pair of the two side flaps is equal to a length of a side wall of the container.

18. The system of claim 13, wherein a height of the container when the container is opened is equal to a combined height of a corresponding bottom portion and a corresponding top portion.

19. A method, comprising:

coating inside surfaces of two container inserts and a container with a moisture resistant coating;

aligning and inserting the two container inserts into the container to cover an inside surface area of the container along a front surface, rear surface, and side surface of the container;

loading a label stack of media into the container between and along an inside surface area defined by the two container inserts;

sealing the container shut and shipping the container to a business;

receiving the container at the business, opening the container along a top of the container, carrying the container via side handles die cut into the container, and aligning and placing the container on a floor or other flat and hard surface of the business to ensure the container is directly under and centered under an infeed for a printer;

removing the container inserts using insert handles die cut into each of the two container inserts leaving the label stack centered within the container with a gap between outer edges of the label stack of media and inside side walls of the container;

orienting any flaps associated with the side handles of the container away from the label stack of media and towards an outside of the container; and feeding a top portion of the label stack of media into the infeed of the printer.

20. The method of claim 19 further comprising, starting or initiating the printer for customer printing or imagining of indicia on labels defined in the label stack of media by the printer.

* * * * *